United States Patent [19]

Lemoine

[11] Patent Number: 4,985,933

[45] Date of Patent: Jan. 22, 1991

[54] VENTILATED BEEKEEPER SUIT

[76] Inventor: Philip G. Lemoine, 801 Little Farms Ave., Metairie, La. 70003

[21] Appl. No.: 232,674

[22] Filed: Aug. 16, 1988

[51] Int. Cl.[5] ..... A41D 13/00; A42B 3/00

[52] U.S. Cl. ..... 2/84; 2/4; 2/DIG. 1

[58] Field of Search ..... 2/4, 84, 22, DIG. 1, 2/DIG. 6

[56] References Cited

U.S. PATENT DOCUMENTS

| | | | |
|---|---|---|---|
| 2,074,390 | 3/1937 | Green | 2/4 X |
| 3,044,075 | 7/1962 | Rawlings | 2/22 |
| 3,191,185 | 6/1965 | Martin | 2/22 |
| 3,783,451 | 1/1974 | Malin | 2/4 |
| 4,422,184 | 12/1983 | Myers | 2/4 |
| 4,697,289 | 10/1987 | Luigi | 2/4 X |
| 4,716,594 | 1/1988 | Shannon | 2/4 |

FOREIGN PATENT DOCUMENTS

| | | | |
|---|---|---|---|
| 267858 | 5/1976 | U.S.S.R. | 2/4 |
| 884668 | 11/1981 | U.S.S.R. | 2/4 |

*Primary Examiner*—Werner H. Schroeder
*Assistant Examiner*—Sara M. Current
*Attorney, Agent, or Firm*—Keaty & Keaty

[57] ABSTRACT

A coverall for a beekeeper, having a main body portion for covering the extremities, including a hood portion, which would comprise multi-layered fabric, including an inside layer which would make contact with the inner clothing or skin of the wearer constructed of a mostly woven net in the neighborhood of 0.4 centimeters per opening, an outside net fabric layer also having openings in the neighborhood of 0.4 centimeters in diameter, with a layer of polyurethane open cells foam having foam elements of approximate 10 pores per linear inch, (100 pores per square inch), of sufficient thickness approximately 0.4–0.6 centimeters so that a bee stinger could not penetrate through the central polyurethane foam core, yet the inside and outside woven net layers would provide structural integrity to the suit, yet allow ventilation between the skin of the wearer and the outside air. The suit is constructed from such uniform flexible multi-layered material in its entirety except for a wire mesh of the face portion.

3 Claims, 2 Drawing Sheets

VENTILATED BEEKEEPER SUIT

BACKGROUND OF THE INVENTION

1. Field of the Invention

The present invention relates to suits for beekeepers. More particularly, the present invention relates to a beekeepers suit, which is ventilated in a manner having an outer and inner layer of medium woven net material net, with an open cell polyurethane layer intermediate the inner and outer net layers, in order to prevent the penetration of bee stings, yet allow thorough ventilation to the wearer of the suit.

2. General Background

In the art of beekeeping, it is imperative that the beekeeper, when working with the bee hives in order to harvest honey, inspect bees in the hive or the like, thoroughly protect the skin from bee stings during this activity. At the present time, there are body suits which are for the most part constructed of tightly woven material which attempts to prevent the bee stings from penetrating to the skin. The shortcoming of this type of suit, is that the tightly woven material does not allow air to freely circulate to the skin of the wearer, and as a result, the wearer gets quite overheated, and usually early fatigue sets in, not to mention a wet uncomfortable feeling from perspiration.

Therefore, there is a constant need in the art for a beekeeper suit which has the ability to protect the wearer from bee stings while working with bee hives, yet at the same time, provide for ventilation through the suit so that the beekeeper could be kept dry and comfortable during his work. Several patents have been granted which relate to garments or fabrics for protecting the skin, the most pertinent being as follows:

U.S. Pat. No. 4,716,594 relates to an insect proof garment covering with a fine knit like material placed over a course rope like material, with the two layers attempting to protect the skin by keeping the insect away from the skin surface. Sagging of the fine material between the course rope like material could be self defeating to prevent stings.

U.S. Pat. No. 4,685,152 issued to Heare, entitled "Insect Protective Garment", provides a garment for insect bites which is constructed of semi-rigid mesh, such as the material used as window screening, and would include hood with a protective face panel attached to the garment, which is not too flexible to wear, and keeps no constant distance from outer layer to skin.

U.S. Pat. No. 4,395,781 entitled "Insect Protective Garment" relates to a light weight insect or animal proof coverall garment having a body portion of lightweight insect excluding material, covering the greater portion of the body, with mesh at the elbows, knees, and shoulders and the face for providing a little ventilation to those parts. It does not claim to prevent stings, and keeps no constant distance from the outer layer to skin.

U.S. Pat. No. 4,397,044 entitled "Protective Bonnet For Beekeeping" teaches the use of a bonnet which would be used by beekeepers including a lower portion that would cover the bust that is manufactured from woven fabric which is non-metallic, and which rests upon the head. There would be included a veil of transparent plastic that is secured with the self-adhesive. It keeps no constant distance from outer layer to the skin.

U.S. Pat. No. 3,783,451 entitled "Insect Protective Garment" relates to an insect netting through which insects cannot penetrate, which is coupled to a plurality of elongated rib members which would contact the skin and which would maintain the netting at a sufficient distance above the skin to prevent insects from reaching the skin. Sagging of fine material between rib members or separating rings could be self defeating to prevent stings.

U.S. Pat. No. 3,191,185 entitled "Snake Proof Trousers And The Like" relates to trousers having a lining adapted to protect the wearer from snake bites. The trousers would include a lining made of expanded lightweight plastic materials such as closed cell styrofoam with an outer material also of fabric. The thickness of the inner lining and the styrofoam would allegedly protect the wearer from snake bites. Ventilation is not found as an important part in the patent.

U.S. Pat. No. 2,189,892 and U.S. Pat. No. 2,074,390 both relate to fabric protectors and are representative of what is in the present state of the art.

SUMMARY OF THE PRESENT INVENTION

The fabric suit of the present invention would solve the problems in the art in a simple and straight forward manner. What is provided is a coverall for a beekeeper, having a main body portion for covering the torso and the extremities, including a hood portion, the coverall comprising a multi-layered fabric, including an inside layer which would make contact with the inner clothing or skin of the wearer, constructed of a square or round hole woven net in the neighborhood of 5/32 inch (4 mm), per opening, an outer net fabric layer also in the range of 5/32 inch (4 mm) per opening, with a layer of polyurethane foam, or other similar type foam materials, having a pore count approximately 10 per linear inch, (100 per square inch), of sufficient thickness so that a honey bee or wasp stinger could not penetrate through the intermediate polyurethane open cell foam core, yet the inner and outer woven net layers would provide structural integrity to the suit, and allow ventilation between the skin of the wearer and the outside air. There would be further provided sewed on straps, such as hook and loop fasteners around the wrist and ankles of the suit for closely adhering these portions of the suit to the wearer so that bees cannot get under the suit, and a hood portion which would be of similar fabric,, including a screened wire face portion, with about 9/64 inch (3 mm) square holes for allowing vision, the hood portion attached to the suit, via a zipper around the neck or the like. At those portions where the fabric must engage in a seam, the fabric would, be backed up by a strap of cloth tape approximately 33/64 inch (13 mm) in width to provide extra protection in those areas.

Therefore, it is a principal object of the present invention to provide a multi-layered fabric suit, which would prevent bee stings to the wearer, yet would allow complete ventilation between the wearer and the outside air.

It is still a further object of the present invention to provide a bee keeper's suit, which would for the most part be a single coverall having a body portion, leg, and arm portions, and a hood portion, which would be easy to slip into, and lightweight in construction, yet provide a sufficient structural integrity as a multi-layered suit to allow a beekeeper to wear quite comfortably with maximum flexibility.

It is still a further object of the present invention to provide a beekeeper suit having inner and outer layers of woven net material, with a intermediate or middle core layer of polyurethane open., cell foam, of sufficient thickness, approximately 5/32–15/64 inch (4–6 mm) thick to protect against bee stings, yet to allow complete air ventilation therethrough, and furnish good support to the outer layers so as to prevent sag, which is not apparent in previous garments.

It is the further object of the present invention to provide a beekeepers suit which can be worn with completely good results, without any undergarments, for the increasing cooling comfort to the wearer.

These and other objects of this invention will be readily apparent to those skilled in the art from the detailed description and claims which follow.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
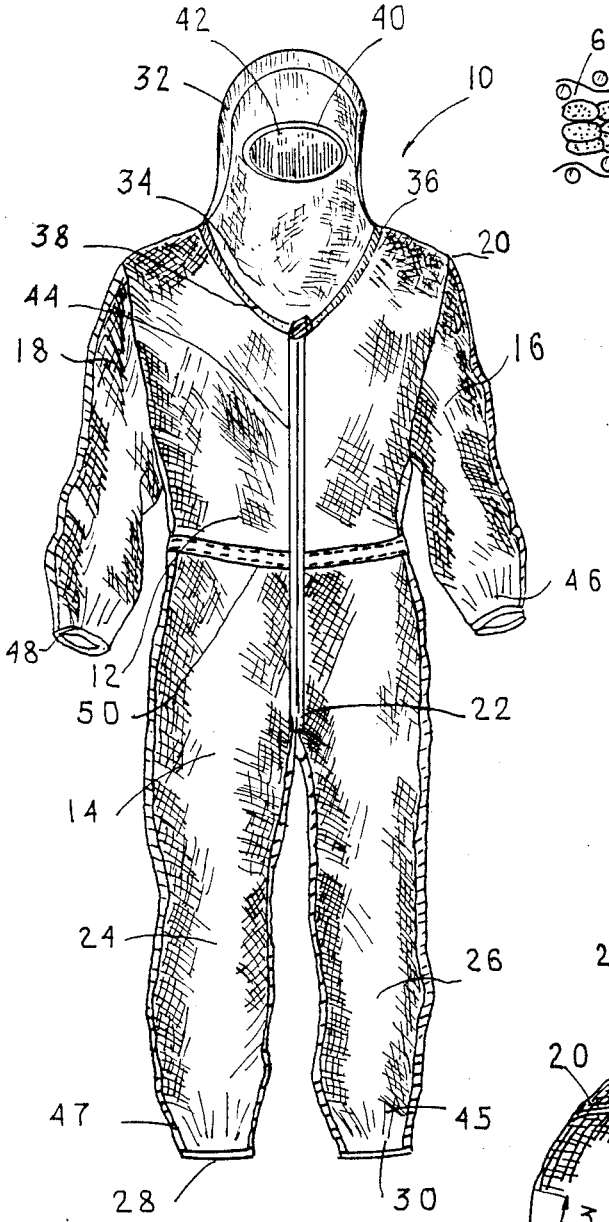
FIG. 1 is an overall composite view of the preferred embodiment of the beekeeper's suit of the present invention.

The beekeeper suit of the present invention is designated in FIG. 1 by the numeral 10. As seen in the Figure, the beekeeper suit 10 provides an overall body suit having a central upper torso portion 12, a lower torso portion 14, the upper torso portion 12 having a pair of arm portions 16 and 18 attached thereto along the shoulder portion seam 20, the suit which may be opened by zipper 44 along a vertical line at 22 for access thereinto. Likewise, the lower torso portion 14 extends into a pair of leg portions 24 and 26, and each leg portion extending down to the ankle line 28 and 30 respectively, so that the suit, in its complete configuration covers the entire body of the wearer, except for hands and feet. Included in the suit is a hood portion 32 having a neck portion 34 which conforms to the upper neck portion 36 of the upper torso 12, so that in the preferred embodiment the hood portion 32 may be attached to the body portion 12 via a continuous zipper 38. The head portion 32 would likewise include a facial mask 40, constructed of wire net 42 so that the wearer could view his task through the viewer 40 during the operations. The net screen 42 would be approximately 0.3 centimeter square holes or 11 squares per square centimeter which would provide no penetration through the wire by bees or the like insects.

Zipper 44 extends from the crouch of the lower torso 14 upward up to the hood 32. Upper torso 12 and lower torso 14 are seamed in the waist 50 to form one complete upper and lower torso unit. Each sleeve 16 and 18 would also include hook and loop fastener straps 46 and 48 respectively so that the wrist portions may be tightened up around the wrists of the wearer, and when gloves are placed on the hand, there would be no access for bees to enter at the wrists of the wearer. Likewise, each ankle portion 28 and 30 would be provided with fastener strips 45 and 47 respectively which would serve the same function as the velcro straps along the wrists of the wearer. In the preferred embodiment, the entire suit may be of a single piece extending through the waist 50, with zipper 44, extending downward through the crotch area of the wearer as with a typical jump-suit.

Figure 6:
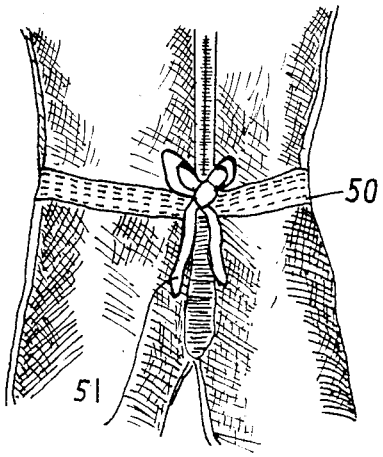
FIG. 6 is an overall composite, partial view of an alternate jacket version of the beekeepers suit of the present invention.

In FIG. 6, there is illustrated an alternate embodiment of the suit, wherein the suit would start from the top of the head portion 32 and end at the waist 50, with the waist 50 provided with a draw string 51 or elastic so that waist 50 can be drawn tight to prevent entry of bees or other insects. This jacket version may be considered for use when making short term inspections of bee hives.

Figure 3:
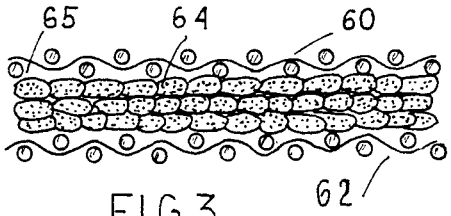
FIG. 3 is a cross-sectional view along lines 3—3 in FIG. 2 in the preferred embodiment of the present invention.
Figure 2:
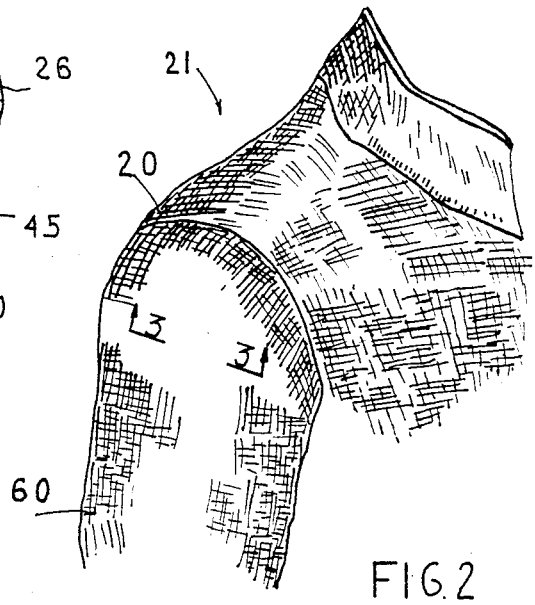
FIG. 2 is a partial view of a portion of the preferred embodiment of the beekeeper's suit of the present invention.
Figure 4:
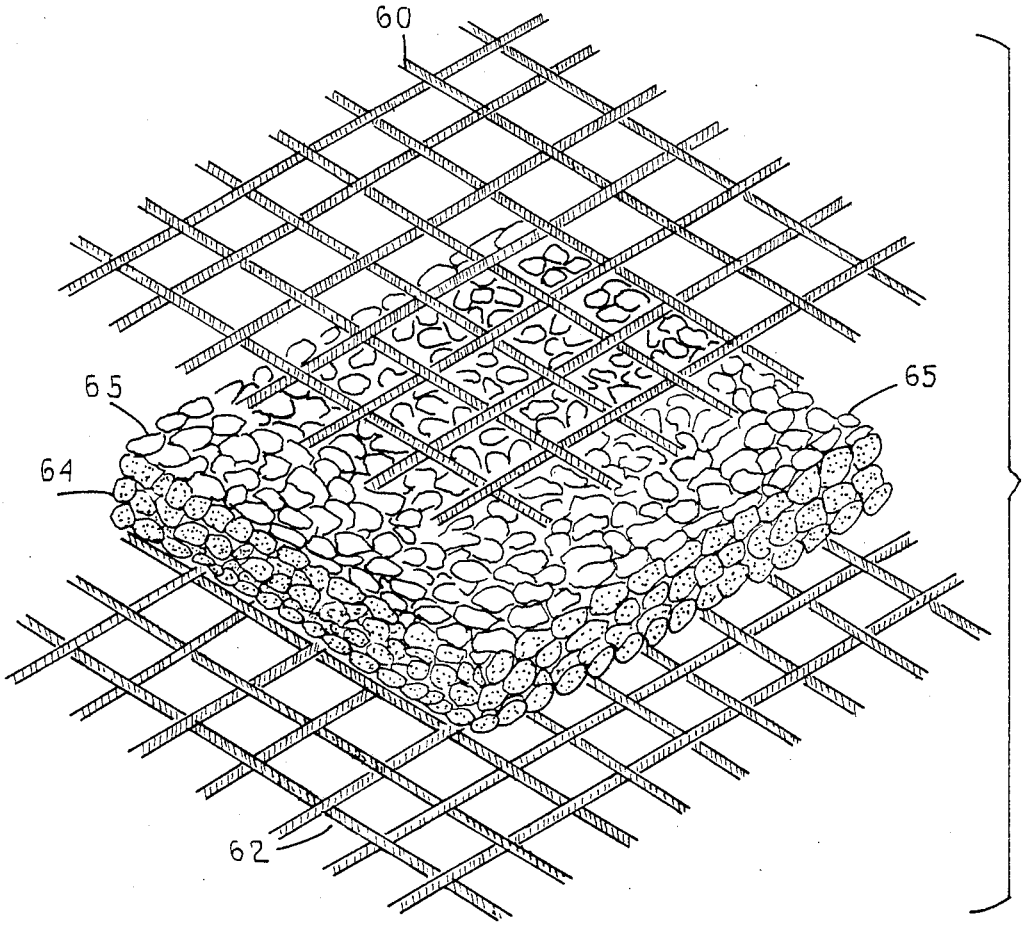
FIG. 4 is an exploded view of the fabric configuration in the preferred embodiment of the beekeeper suit in the present invention.

Turning now to the most critical part of the invention, or the fabric with which the suit is constructed, reference is made to FIGS. 2, 3, and 4 of the present invention. In FIG. 2 there is illustrated shoulder portion 21, wherein there is shown an outside net layer 60, being of a net fabric, with square or round holes in the neighborhood of 5/32 inch (4 mm) per opening, which would comprise a woven net. The holes of the mesh could vary from 5/64 inch (2 mm) to 0.39 inch (1 cm) per opening. This net fabric as was stated earlier, and as illustrated in FIG. 3 would comprise an outside net layer 60 and an inside net layer 62 of similar pore structure of outside layer 60, with inside net, layer 62 making contact with the skin of the wearer if there are no undergarments, or of course, making contact with the undergarments of the wearer. The presence of the inside and outside woven net layer fabrics 60 and 62 would provide structural integrity to the suit fabric as the suit is being put on or taken off, and would eliminate any possibility that the wearer's hands or feet would make contact with the core layer of polyurethane, or other similar foam materials, as will be discussed further. It should be noted that the net, layers 60 and 62 are of sufficient hole size to provide structural integrity of fabric, yet not so small as not to allow air to ventilate therethrough as will be discussed further.

Figure 5:
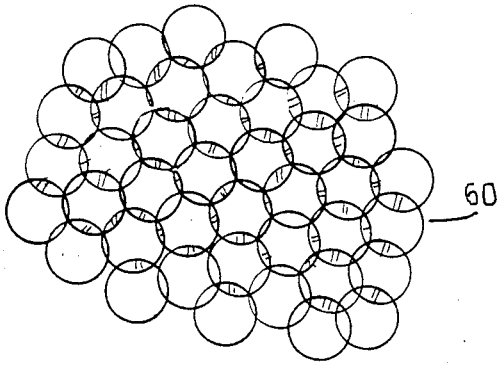
FIG. 5 is a view of the outer or inner layer of fabric configuration in an alternate embodiment of the beekeeper suit of the present invention.

FIG. 5 illustrates an alternate embodiment of the net layer 60 ,62 of the present invention. Rather than the net layer comprising a plurality of square holes as illustrated in FIG. 4, the net layer 60, 62 would provide a plurality of round holes as illustrated in the figure.

Turning again to FIGS. 3 and 4, reference is made to the polyurethane layer 64 which is positioned intermediate the outside fabric layer 60 and the inside fabric layer 62. Polyurethane layer 64 would comprise polyurethane, or other similar foam materials, in the form of individual but connected foam members 65 which would be for the most part irregularly shaped as seen in FIG. 4, and would take up approximately 10 pores per linear inch or 100 pores per square inch. Therefore, it can be seen, foam layer 64 is a somewhat thickened and more loosely compiled layer, and would range anywhere from 5/64 to 15/64 inch (2–6 mm) in thickness and may be even up to at least 0.468 inch (1.2 cm) in thickness. Therefore, by this configuration of foam members 65 contained in the intermediate layer 64, the layer is of sufficient thickness to prevent the intrusion of a bee sting to the skin of the wearer should a bee attempt to sting through the material, and therefore protect the wearer. However, and perhaps as important, is the fact that the polyurethane cell members 65 in a layer 64 allow a complete flow of air through the members 65 from the outside into the skin of the wearer during use, and therefore, provides a great deal of comfort for the wearer. Therefore, the total thickness of the material, including the inside and outside and intermediate layers would be preferably 0.18–0.37 inch (0.46–0.94 cm) thickness overall, yet due to the configuration of the net, and the polyurethane foam, would allow for ventilation, as seen in exploded view in FIG. 4.

Further, the finer and slightly staggered pores of the polyurethane foam allow a sufficient thickness to the suit to be much less vulnerable to stings than is found in the present state of the art, since it is foreseen that an insect stinger would be less likely to follow the slightly staggered pores from the outside of suit to the interior and to the skin. The polyurethane foam would provide a more constant distance from the outer side of the fabric to the skin area.

The net fabric as the inner layer of the inside of the multi-layer fabric defines a smoother and more comfortable suit to wear, more particularly in the elbows and knees and assist in putting on and taking off of the suit. The fine net would eliminate tearing as one's foot is fitted through the leg of the suit.

One important aspect of the invention is the manner in which the seams are arranged. For purposes of providing protection to the wearer at the seams, it is foreseen that the fabric at the seams would be folded over and sewn as with regular fabric, and in this double manner, would provide sufficient thickness although the thread penetrating the fabric would tend to compress it slightly. In an abundance of caution, it is foreseen that a tape, such as a cloth bias tape 70 could be placed at each seam to assure that a bee attempting to sting on that particular seam does not penetrate the slightly compressed thickness of the fabric.

It is through this novel combination of the polyurethane foam layer comprising the polyurethane foam members, positioned intermediate the outside and inside layers, such as 36 holes per square inch fabric netting, which provide this novel suit with the structural integrity for wearing by a beekeeper, yet at the same time provides a measure of protection against bee stings, and thorough ventilation through the fabric during the wearing of the suit. This multi-construction in that fabric configuration has not been found in the art, and is certainly a novel approach to solving both the problems of protection against bee stings and maintaining air circulation to the wearer of the suit.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A ventilated beekeepers suit, of the type having a principal body portion, arm and leg portions, and a hood portion, the suit comprising an integral suit body formed from a substantially uniform flexible multi-layered material, wherein said material comprises;

(a) a first outside fabric layer of medium net having a pore count in the range of 0.2–1 centimeters per opening;

(b) a second inside fabric layer of medium woven mesh having a pore count in the range of 0.2–1 centimeters per opening;

(c) an intermediate layer of polyurethane open cell material of sufficient thickness to serve as a protective barrier against bee stings, having a pore count in the range of approximately 7–20 pores per linear inch or 49–400 pores per square inch;

the outside fabric layer, the intermediate polyurethane layer, and the inside fabric layer defining a multi-layered composite material for protecting a beekeeper from stings, yet of sufficient spacing for allowing air to ventilate between outside of the suite and skin of the wearer.

2. A beekeeper suit for covering at least an upper torso of a user, the suit comprising an upper torso portion, arm portions and a hood portion, the suit being formed of a substantially uniform flexible material which comprises a first outside fabric layer of medium net, a second inside fabric layer of medium net and an intermediate layer uniformly extending between the first and the second layers, the intermediate layer being formed of open cell polyurethane material of sufficient thickness to serve as a continuous protective barrier against bee stings, the intermediate layer having a pore count in the range of approximately 10 pores per linear inch for allowing air to penetrate through the flexible material.

3. The beekeepers suit of claim 2, wherein the first outside layer and a second inside layer are made of medium net having openings in the range of 0.2 to 1 centimeter.

* * * * *